US008465196B2

(12) United States Patent
Faccioli et al.

(10) Patent No.: US 8,465,196 B2
(45) Date of Patent: Jun. 18, 2013

(54) BONE CEMENT MIXER

(75) Inventors: Giovanni Faccioli, Monzambano (IT); Renzo Soffiatti, Nogara (IT)

(73) Assignee: Tecres S.p.A., Sommacampagna (IT)

( * ) Notice: Subject to any disclaimer, the term of this patent is extended or adjusted under 35 U.S.C. 154(b) by 416 days.

(21) Appl. No.: 12/544,326

(22) Filed: Aug. 20, 2009

(65) Prior Publication Data

US 2011/0044124 A1 Feb. 24, 2011

(51) Int. Cl.
*B01F 11/00* (2006.01)

(52) U.S. Cl.
USPC ..... 366/114; 366/130; 366/275

(58) Field of Classification Search
USPC ..... 366/110–116, 126, 130, 275; 206/220
See application file for complete search history.

(56) References Cited

U.S. PATENT DOCUMENTS

| | | | | | |
|---|---|---|---|---|---|
| 2,184,152 | A * | 12/1939 | Saffir | 206/222 |
| 2,469,525 | A * | 5/1949 | Skrob | 366/126 |
| 2,889,067 | A * | 6/1959 | Medicus | 220/2.2 |
| 3,489,306 | A * | 1/1970 | Bubb | 215/6 |
| 3,963,120 | A * | 6/1976 | Perfect | 206/219 |
| 5,193,907 | A * | 3/1993 | Faccioli et al. | 366/130 |
| 5,394,980 | A * | 3/1995 | Tsai | 206/63.5 |
| 5,435,645 | A * | 7/1995 | Faccioli et al. | 366/130 |
| 5,951,160 | A * | 9/1999 | Ronk | 366/130 |
| 7,018,089 | B2 * | 3/2006 | Wenz et al. | 366/130 |
| 8,042,604 | B2 * | 10/2011 | Nozaki et al. | 165/10 |
| 2004/0264293 | A1 * | 12/2004 | Laugharn et al. | 366/127 |
| 2008/0029247 | A1 * | 2/2008 | Nozaki et al. | 165/104.17 |
| 2008/0316855 | A1 * | 12/2008 | Ferrante et al. | 366/134 |

* cited by examiner

*Primary Examiner* — David Sorkin
(74) *Attorney, Agent, or Firm* — Tutunjian & Bitetto, P.C.

(57) ABSTRACT

Mixer for obtaining bone cement for medical applications comprising a mixing chamber in which the mixing of at least two components which form the cement is carried out, comprising means for generating and transmitting vibrations to the mixing chamber and a luer attachment through which the cement can exit.

10 Claims, 3 Drawing Sheets

FIG. 5
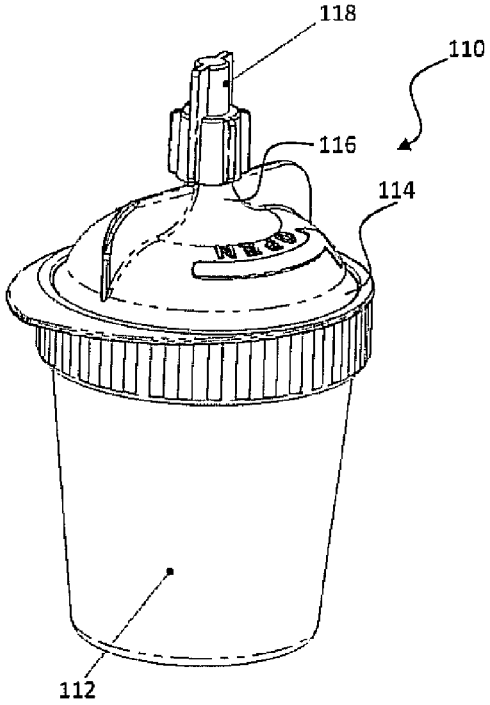
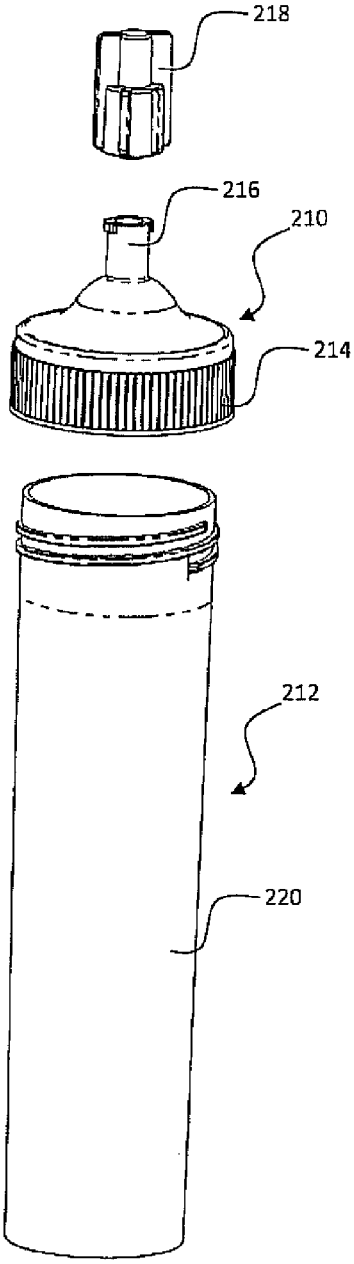
FIG. 6

BONE CEMENT MIXER

The invention refers to a bone cement mixer.

In surgery, bone cement is very often used for the reconstruction of bones.

It is normally prepared through two components, one liquid (monomer) and one in powder (polymer), kept separate from one another right until they are mixed at which point they bond together. The mixing is carried out when the worker pours the liquid component into the container with the powder to form a cement-like mixture.

It is preferable to mix the two components in closed containers, in order to avoid diffusion of vapours. These containers are usually equipped with a mixer member, usually a piston or a spatula which can be actuated manually. The cement is then transferred and injected onto the bone through a syringe.

It is a trend for surgeons to search for ever more dense cement, because they are more easily applied whilst having a lower tendency to leak inside the body. However, having a higher density requires more strength while mixing, and therefore there is the parallel problem of suitably mixing the two cement components without excessive strain.

The object of the invention is that of making the aforementioned mixing of the cement in medical devices easier obtaining it through "knocking or vibration" applied to the walls of the mixer.

Such an object is obtained with a mixer for forming bone cement for medical applications comprising a mixing chamber in which the mixing between at least two components which form the cement can be carried out, the chamber being defined by walls of the mixer, characterized in that it comprises means for generating and transmitting vibrations at the outer side of at least one wall of the mixing chamber.

The generating and transmitting means can be made in many ways.

An electric energy vibration generator can be used, like for example an eccentric fitted onto an electric motor in abutment against a wall of the mixing chamber. Power can be supplied, for example, through batteries integrated in the mixer. Otherwise, the shaking movement which is given to the mixer by the worker during the mixing could be exploited. In this case it is advantageous to make the means for generating and transmitting vibrations having a mass free to oscillate (knocker) and knock against an outer side of at least one wall of the mixing chamber.

The free mass can be a sphere or in general a body fixedly connected to the mixer, for example, by a cable. Or the mass can be contained inside a closed chamber which shares a wall with the mixing chamber, thus improving its integration with the mixer and making it more compact.

In order to increase the effectiveness of the knocking mass, the shared wall between said closed chamber and said mixing chamber is equipped with thinner portions to favour a sussultatory movement of the shared wall itself. The rigidity of the shared wall is thus reduced increasing the bending capacity thereof and further moving the forming cement.

The invention also solves the coupling problem of the mixer with the device used to inject the cement into the bone, usually a syringe or a press dispenser.

The mixer should have a structure able to prevent contamination of the cement from the environment and make the application and use operations in the operating room easier.

For this purpose, the invention providing the mixer with a luer fitting through which the cement can exit, the luer fitting being easily coupled with a syringe and/or dosage tubes. Preferably the mixer comprises a luer cap for the luer fitting.

Further characteristics and advantages of the invention shall become clearer from the description given as an example of a mixer, together with the attached drawings in which:

FIG. 5 shows a side view of a second mixer according to the invention;

FIG. 6 shows a side view of a second mixer according to the invention.

Figure 1:
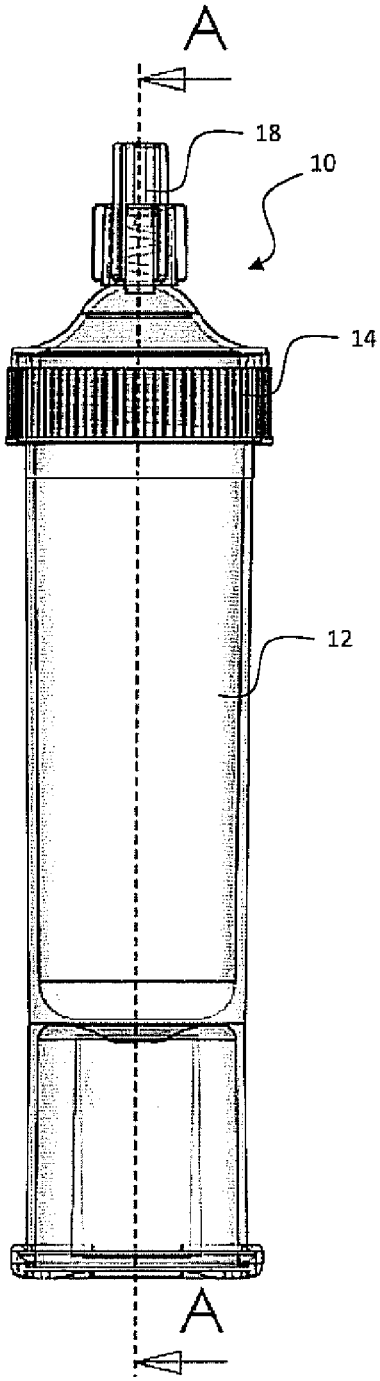
FIG. 1 shows a side view of a mixer according to the invention.

A mixer according to the invention is indicated with reference numeral 10.

Said mixer comprises a cylindrical case 12 which extends along an axis X and which defines a mixing chamber 20 inside of it, and another open chamber 40 adjacent to the first one and with which it shares a common wall 30.

Figure 2:
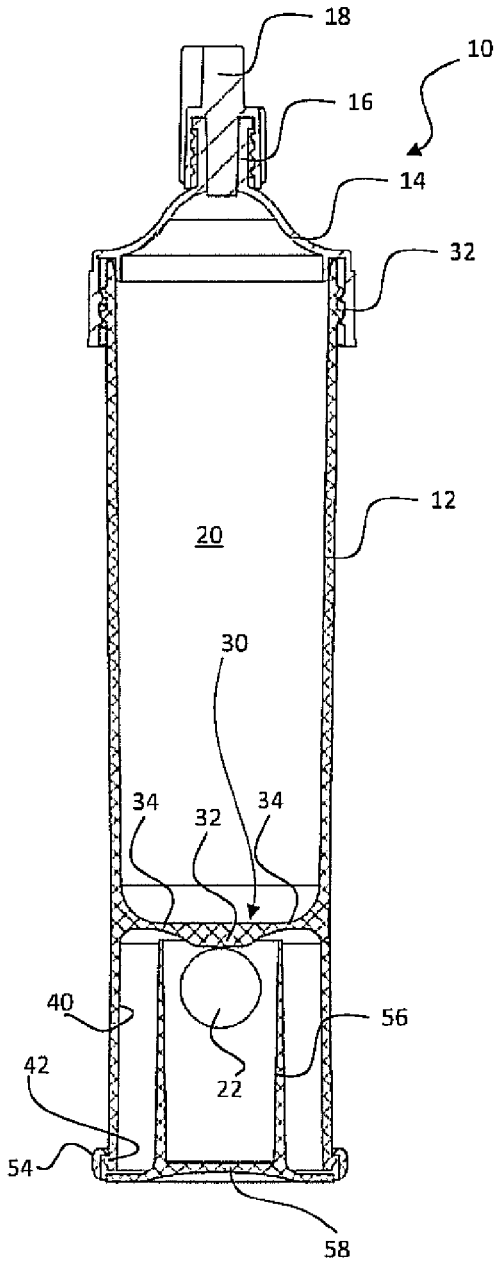
FIG. 2 shows a section view of the mixer of FIG. 1 according to the plane A-A of FIG. 1.

The mixing chamber 20 is open towards the outside and at the corresponding end of the mixer 10, on its outer side surface, there is a thread 32 onto which a lid 14 can be screwed to close the chamber, forming one of its walls. (see FIG. 2). Once the components to be mixed have been deposited in the chamber 20, the cap 14 is applied and closed. The lid 14 is tapered and has a luer fitting opening 16 at its apex, closed by a luer cap 18.

Figure 3:
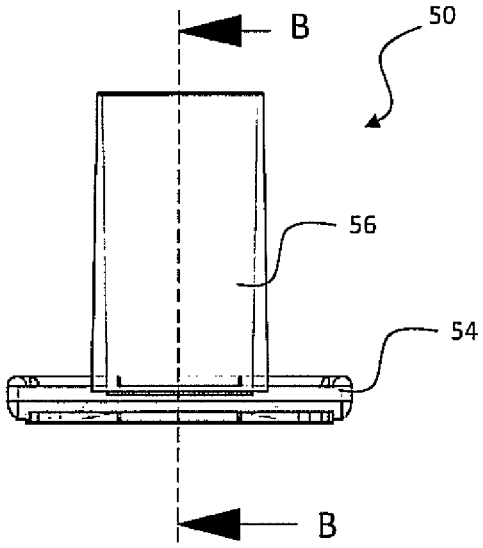
FIG. 3 shows a side view of a component of the mixer of FIG. 1.
Figure 4:
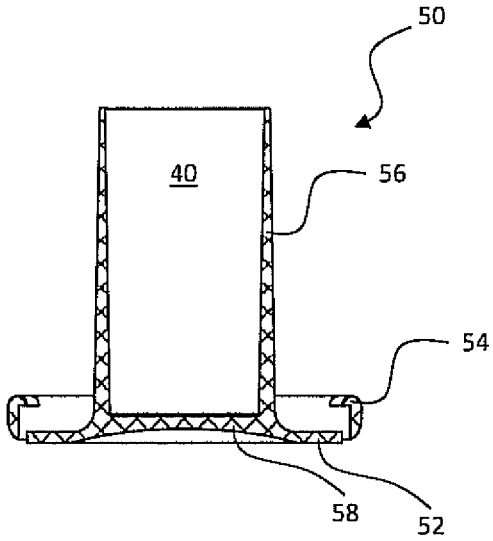
FIG. 4 shows a section view of the component of FIG. 3 according to the plane B-B of FIG. 3.

A closing element 50 can be inserted snapping into the chamber 40 (see FIGS. 3 and 4). The closing element comprises a circular base 52 and a hollow cylindrical central body 56 open at one end and closed at the bottom 58. The base 52 has a peripheral lip 54 suitable for snapping onto an edge in relief 42 on the outside of the case 12. Inside the body 56 there is a small sphere 22, smaller in size, which is free to move inside of the body and to knock against its walls.

The chamber 40 has an oblong shape and a depth almost equal to the height of the body 56, so that the second one can be inserted into the first (FIG. 3). It should be seen that the small sphere 22 can substantially move with a good clearance from and towards the wall 30 (along the axis X) staying within the body 56.

The section of the wall 30 is not even. It has a central portion 32 which is thicker and an annular portion 34 which is thinner. In this way the ability of the portion 32 to oscillate with respect to the case 12 is increased.

The operation of the mixer 10 is as follows. The element 50 is applied to the mixer 10 and the components to be mixed are introduced into the chamber 20, after closing it with the lid 14. Then the mixer 10 should be held in hand and shaken. Consequently, the small sphere 22 is set in motion inside the chamber 40 and repeatedly knocks against the wall 30. The mixing of the components is obtained thanks to manual shaking, and a further mixing effect is developed through the vibrations generated by the impact of the sphere 22 against the wall 30. Even though the cement has high density, such vibrations are unexpectedly able to improve the mixing.

It should also be noted that the funnel-shaped hermetically sealing lid 14 ends with a luer fitting 16, which allows a syringe to be connected to it and thus directly aspirate the mixed cement. This means there is an optimal asepticity of the cement. The luer cap 18 further improves the characteristics of adaptability and simplicity of use of the mixer 10.

The solution with luer fitting can be implemented to other mixers as well, with or without knocking mass. FIGS. 5 and 6 show some examples, the first one is of a cup mixer 110 which comprises a cylindrical case 112 and which defines a mixing chamber inside of it. Such a mixing chamber is open towards the outside and it is closed by a tapered lid 114 which has a luer fitting 116 at its apex, and it is closed by a luer cap 118.

The second mixer 210 comprises a cylindrical case 212 and it defines a mixing chamber 220 inside of it. Such a mixing chamber is open towards the outside and it is closed by a tapered lid 214 which has a luer attachment 216 at its apex and it is closed by a luer cap 218.

The invention claimed is:

1. Mixer for obtaining bone cement for medical applications comprising:

a cylindrical case comprising:

a mixing chamber adjacent to an open chamber, each of said mixing chamber and open chamber being defined by walls of the cylindrical case;

a common wall shared between the open chamber and the mixing chamber, wherein the common wall includes a thicker central portion and a thinner annular portion;

a closing element comprising a hollow oblong body defining a cavity and having an open end and a closed end, the closing element being inserted into the open chamber so that the open end is oriented only over the thicker central portion of the common wall; and a mass contained inside the cavity of the hollow oblong body and free to oscillate and knock against the thicker central portion of the common wall between the open chamber and the mixing chamber.

2. Mixer according to claim 1, comprising a Luer fitting through which the cement can exit.

3. Mixer according to claim 2, comprising a Luer cap for the Luer fitting.

4. Mixer of claim 1, wherein the thinner annular portion enables the central portion to oscillate with respect to the cylindrical case defining the mixing chamber.

5. The mixer of claim 1, wherein a total width of the open end of the hollow oblong body is less than a total width of the open chamber.

6. The mixer of claim 1, wherein a total width of the open end of the hollow oblong body is equal to a total width of the thicker central portion of the common wall.

7. A hand activated mixer for obtaining bone cement for medical applications comprising:

a case comprising:

a mixing chamber adjacent to an open chamber, each of said mixing chamber and open chamber being defined by walls of the case, wherein the mixing of at least two components which form the cement can be carried out in the mixing chamber;

a common wall shared between the open chamber and the mixing chamber;

a closing element comprising an oblong body having side walls and a bottom defining a cavity and having an open end and a closed end, the closing element being inserted into the open chamber so that the open end is oriented over the common wall;

the closed end of the oblong body including a base having a lip; and a mass contained inside the cavity of the hollow oblong body and free to oscillate and knock against the common wall, and the side walls and the bottom of the oblong body.

8. The hand-activated mixer of claim 7, said common wall comprising a vibrating membrane.

9. The hand-activated mixer of claim 8, said vibrating membrane comprises a smooth vibrating membrane free of protrusions.

10. The hand-activated mixer of claim 7, wherein said lip directly contacts said case when the closing element is inserted into the open chamber to provide a direct vibrating continuity of the oblong body with the mixing chamber.

* * * * *